United States Patent [19]

Brown et al.

[11] Patent Number: 4,675,621

[45] Date of Patent: Jun. 23, 1987

[54] TEMPERATURE COMPENSATED CIRCULATOR

[75] Inventors: Stewart L. Brown; Andrew J. Cartin, both of Dallas, Tex.

[73] Assignee: Decibel Products, Inc., Dallas, Tex.

[21] Appl. No.: 796,744

[22] Filed: Nov. 12, 1985

[51] Int. Cl.[4] ..... H01P 1/387

[52] U.S. Cl. ..... 333/1.1; 333/24.1

[58] Field of Search ..... 333/1.1, 24.1; 335/217

[56] References Cited

U.S. PATENT DOCUMENTS

| | | | |
|---|---|---|---|
| 3,614,670 | 10/1971 | Wilson | 333/1.1 |
| 3,935,549 | 1/1976 | Jachowski | 333/1.1 |
| 4,209,756 | 6/1980 | Jin et al. | 333/1.1 |
| 4,276,522 | 6/1981 | Coerver | 333/1.1 |
| 4,456,898 | 6/1984 | Frischmann | 335/217 |

OTHER PUBLICATIONS

Lissner, *Temperature Compensated Permanent Magnet,* IBM Tech. Discl. Bulletin, vol. 15, No. 5, Oct. 1972, p. 1422.

*Primary Examiner*—Paul Gensler

*Attorney, Agent, or Firm*—Richards, Harris, Medlock & Andrews

[57] ABSTRACT

A microwave ferrite circulator has a conductive junction with three equal angular conductors connected to serve as ports of the circulator. Ferrite plates are positioned on opposite sides of the conductive junction. Magnetic members form a magnetic coupling path between a permanent magnet and the ferrite plates. A bimetal strip is positioned in the magnetic coupling path between the magnet and the ferrite plates for altering the coupling as a function of temperature to thereby compensate for changes in tuning due to changes in temperatures of the circulator.

7 Claims, 5 Drawing Figures

FIG. 1
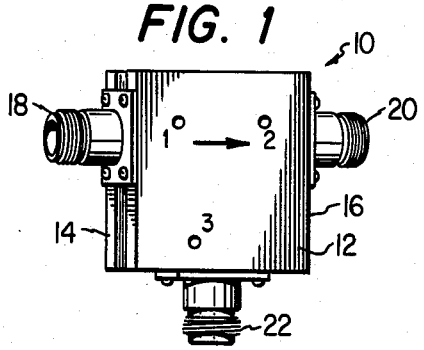
FIG. 3
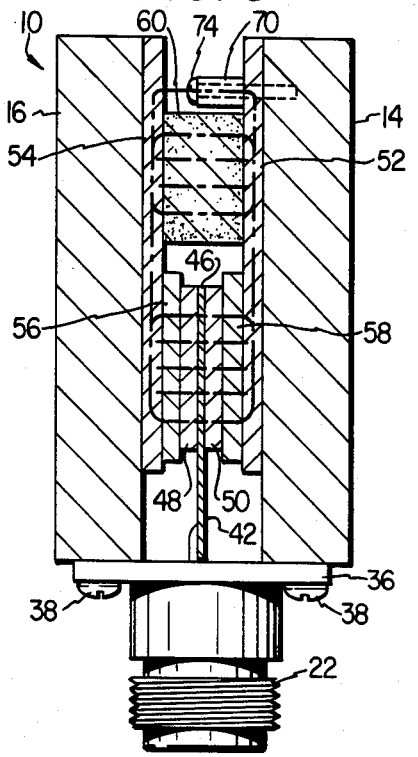
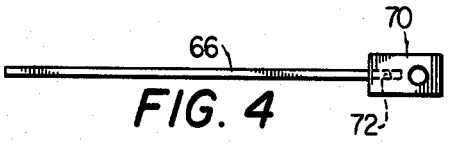
FIG. 4
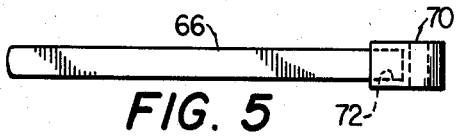
FIG. 5
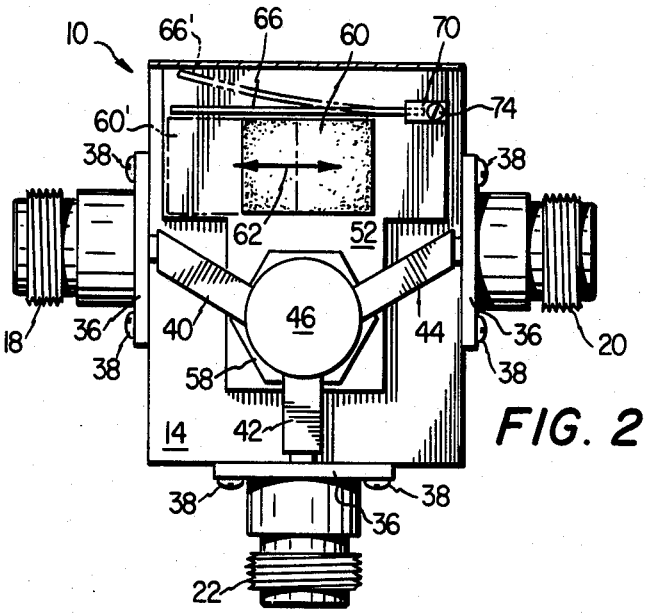
FIG. 2

TEMPERATURE COMPENSATED CIRCULATOR

FIELD OF THE INVENTION

The present invention pertains in general to high frequency electrical components and in particular to a three port ferrite circulator.

BACKGROUND OF THE INVENTION

Ferrite circulators have been used for many years in the UHF and microwave frequency range. Such a circulator is a three port device consisting of ferrite material, one or more magnets, three short transmission lines and a central conductive junction. A circulator typically functions as an isolator to substantially reduce power transfer between two of the ports.

In a typical application, power enters port 1 of the circulator and is rotated to emerge at port 2. Power entering port 2 emerges at port 3 and the power entering at port 3 emerges at port 1. In most applications, one of the ports is terminated with a fixed load resister.

The magnets within a ferrite circulator provide a fixed bias magnetic field which is applied to the ferrite material and central conductive junction. Circulators are tuned to operate at selected frequency ranges. A primary factor in the tuning of a circulator is the intensity of the magnetic field which is applied to the ferrite material. A method for adjusting the intensity of this magnetic field is presented in U.S. Pat. No. 3,935,549 to Jachowski.

A principle problem encountered in the use of ferrite circulators is the buildup of heat which is produced when the microwave energy is dissipated within the various elements of the circulator. As the temperature of the circulator increases due to heat buildup, the tuned frequency of the circulator can also change. Thus, a circulator which is tuned at a relatively low temperature can be driven out of its tuning condition as heat is built up within the circulator. When a circulator is operated at an out of tune condition, there is greater dissipation of the signal that is transmitted through the circulator. This reduces the effective power which should be transferred through the circulator.

The problem of heat buildup in circulators has been addressed in several prior patents. U.S. Pat. No. 3,621,476 discloses a circulator which has a heat sink and U.S. Pat. No.3,452,298 discloses a circulator which includes temperature compensating gyromagnetic material.

In view of the problem of heat buildup within ferrite circulators and the resulting detuning of the circulators, there exists a need for a temperature compensated circulator which can operate over a broad temperature range without substantially detuning the circulator.

SUMMARY OF THE INVENTION

A selected embodiment of the present invention comprises a temperature compensated circulator which includes a pair of spaced apart, electrically conductive plates on opposite sides of a planar conductive junction. The junction is connected to three conductors which extend outward at equal angles from the junction with the conductors serving as ports to the circulator. A pair of ferrite plates are positioned adjacent and on opposite sides of the conductive junction. An optional pair of magnetic members are positioned on opposite sides of the pair of ferrite plates with the magnetic members being supported by the conductive plates. At least one permanent magnet is supported by the conductive plates for producing a magnetic field which passes through the magnetic members and the ferrite plates. A bimetal member is mounted in the magnetic field of the magnet for changing position in the magnetic field as a function of the temperature of the bimetal member. The bimetal member alters the magnetic coupling between the magnet and the ferrite plates for changing the intensity of the magnetic field applied to the ferrite plates as a function of the position of the bimetal member.

BRIEF DESCRIPTION OF THE DRAWINGS

For a more complete understanding of the present invention and the advantages thereof, references is now made to the following description taken in conjunction with the accompanying drawings in which:

FIG. 1 is a perspective view of a circulator in accordance with the present invention, FIG. 2 is a plan view of the circulator of the present invention having various members removed to expose the interior of the circulator, FIG. 3 is a section view of the circulator of the present invention, FIG. 4 is an elevation view of a bimetal element and mount as shown in FIGS. 2 and 3, and FIG. 5 is a plan view of the bimetal strip and mount shown in FIG. 4.

DETAILED DESCRIPTION OF THE INVENTION

Referring now to FIG. 1, there is illustrated a ferrite circulator 10 in accordance with the present invention. The circulator 10 comprises a housing 12 which includes spaced apart, electrically conductive plates 14 and 16. The circulator 10 is provided with three coaxial connectors 18, 20 and 22. These connectors serve respectively as ports 1, 2 and 3 for the circulator 10. Energy transfer is principally between ports 1 and 2 which correspond to connectors 18 and 20. In a typical application port 3, connector 22, is connected to a termination resistor to absorb energy that is received into port 2.

The internal structure of the circulator 10 is now described in reference to FIG. 2. Each of the connectors, 18, 20 and 22 is connected by respective flanges 36, by use of screws 38, to the plates 14 and 16. Each of the coaxial connectors 18, 20 and 22 is provided with a center conductor and these conductors are connected respectively to flat conductive strips 40, 42 and 44. These strips are connected at equal angles to a conductive junction 46. Further referring to FIG. 3, it can be seen that the conductive junction 46 is positioned midway between the conductive plates 14 and 16. Ferrite discs 48 and 50 are positioned adjacent and on opposite sides of the conductive junction 46.

Magnetic members 52 and 54 are connected respectively to the interior surfaces of the conductive plates 14 and 16. Pole pieces 56 and 58 are positioned adjacent to and between the magnetic members 52 and 54. The pole pieces 56 and 58 also serve as magnetic members. The pole piece 56 is positioned between the ferrite disc 48 and the magnetic member 54. The pole piece 58 is positioned between the ferrite disc 50 and the magnetic member 52.

Referring to both FIGS. 2 and 3, a permanent magnet 60 is positioned immediately between the magnetic members 52 and 54, while being between the conductive plates 14 and 16. The magnet 60 is movable back and forth as indicated by the arrow 62. The positioning of the magnet 60 provides tuning for selecting the operating frequency of the circulator 10. The magnet 60 is shown in an alternate position indicated by the reference numeral 60'.

The circulator 10 further includes a bimetal strip 66 which is mounted at one end to a mounting block 70. In the preferred embodiment the mounting block 70 is made of brass, although any material suitable for mounting the bimetal strip 66 may be used. The bimetal strip 66 is secured within a slot 72 in the block 70. Block 70 itself is mounted by means of a screw 74 to the magnetic member 52 and the conductive plate 14. The mounting block 70 and the screw 74 are further illustrated in FIGS. 3, 4 and 5. The bimetal strip 66 is also further shown in FIGS. 4 and 5.

The bimetal strip 66 is typically mounted, for room temperature, to be in a position which is near the magnet 60. A representative embodiment of the bimetal strip 66 is manufactured by GTE Laminates, Reidsville, North Carolina. As the bimetal strip 66 becomes warmer, it deflects upward to a position indicated by dotted lines and marked by the reference numeral 66'.

Operation of the temperature compensated circulator 10 in accordance with the present invention is now described in reference to FIGS. 2 and 3. The circulator 10 is tuned to a desired operating frequency by positioning the magnet 60 in a selected position indicated by the arrow 62. However, this tuning can only set the operating frequency of the circulator 10 for a particular temperature. In operation, microwave energy is dissipated within the circulator 10 principally within the ferrite discs 48 and 50. As these discs become warmer, the tuned frequency of the circulator 10 increases. As the magnet 60 becomes warmer, its magnetic flux intensity decreases, which further increases the tuned frequency of the circulator 10. As the tuned frequency of the circulator goes further from the frequency of the signal passing through the circulator, the signal is further dissipated, causing generation of additional heat. In a routine installation, the circulator 10 may operate over a wide range of temperatures. It is, therefore, not possible to anticipate a single operating temperature for appropriately positioning the magnet 60.

The magnet 60 produces a magnetic field that is coupled through the magnetic members 52 and 54, the pole pieces 56 and 58 to the ferrite disc 48 and 50 and through the junction 46. This coupling path also includes the bimetal strip 66. However, a portion of the magnetic flux transmitted from the magnetic 60 to the ferrite discs 48 and 50 is blocked by the bimetal strip 66. As the circulator 10 becomes warmer, the bimetal strip 66 likewise increases in temperature. As the strip 66 becomes warmer, the free end of the strip deflects outward away from the magnet 60. This change in position by the strip 66 alters the magnetic coupling between the magnet 60 and the ferriet discs 48 and 50. This in turn increases the intensity of the magnetic field which is applied to the ferrite discs 48 and 50. By altering the intensity of the magnetic field applied to the ferrite discs 48 and 50, the tuned frequency of the circulator 10 is altered. The bimetal strip 66 is selected and positioned to alter the magnetic field applied to the ferrite discs 48 and 50 in such a way as to counteract the change in frequency of the circulator 10 due to a buildup of heat. The bimetal strip 66 itself is positioned to provide the required reverse compensation to changes in temperature. The compensation characteristics for the strip 66 can be selected by altering the width and length of the strip 66, varying the offset of the strip 66 from the magnet 60, twisting the strip 66, and by altering the angle of the strip 66 relative to the magnet 60. A coil configuration for the strip 66 is also an option.

In summary, the present invention comprises a temperature compensated ferrite circulator which has a permanent magnet that is coupled to a ferrite plate or plates. A bimetal strip is mounted in the coupling path between the magnet and the ferrite plates such that movement of the bimetal strip alters the magnetic coupling between the magnet and the ferrite plate to compensate for a shift in frequency of the coupler due to a rise in its temperature.

Although one embodiment of the invention has been illustrated in the accompanying Drawings and described in the foregoing Detailed Description, it will be understood that the invention is not limited to the embodiment disclosed, but is capable of numerous rearrangements, modifications and substitutions without departing from the scope of the invention.

What we claim is:

1. A temperature compensated circulator, comprising:

a pair of spaced apart, electrically conductive plates, a planar conductive junction located between said plates, said junction joined to three conductors extending outward at equal angles from said junction, said conductors comprising ports to said circulator, a pair of ferrite plates positioned adjacent and on opposite sides of said junction, at least one permanent magnet for producing a magnetic field which passes through said junction and said ferrite plates, and a layered bimetal strip positioned in the magnetic field of said magnet for changing position in the magnetic field as a function of the temperature of the bimetal strip, said bimetal strip altering the magnetic coupling between said magnet and said ferrite plates for changing the intensity of said magnetic field applied to said ferrite plates as a function of the position of said bimetal strip.

2. A temperature compensated circulator as recited in claim 1, including a pair of magnetic members positioned on opposite sides of said ferrite plates for conveying said magnetic field.

3. A temperature compensated circulator as recited in claim 2, wherein said magnetic members extend to a location away from said ferrite plates and said magnetic members.

4. A temperature compensated circulator as recited in claim 2, wherein said bimetal strip is connected at one end to a mount which is joined to one of said magnetic members.

5. A temperature compensated circulator as recited in claim 1, wherein said magnet is elongate and said bimetal strip is adjacent to but not in contact with said magnet.

6. A temperature compensated circulator as recited in claim 1, wherein said bimetal strip is located at a first position relative to said magnet at a first temperature and said-strip deflects to a second position farther from said magnet at a second temperature.

7. A temperature compensated circulator, comprising:

a pair of spaced apart, parallel, electrically conductive plates, a planar conductive junction located between said plates, said junction joined to three conductors extending outward at equal angles from said junction, said conductors comprising ports to said circulator, a pair of ferrite discs positioned adjacent and on opposite sides of said junction, a pair of planar pole members positioned adjacent and on opposite sides of said pair of ferrite discs, a pair of planar magnetic members positioned adjacent and on opposite sides of said pair of pole members, said magnetic members having a portion thereof extending to a location away from said ferrite discs, a permanent magnet positioned at said location between said magnetic members for providing a magnetic field, and a layered bimetal strip mounted at one end thereof to one of said magnetic members and having the opposite end free to move in response to changes in temperature of said bimetal strip, wherein said magnetic field is coupled through said magnetic members, said pole members, said bimetal strip, said ferrite discs and said conductive junction, whereby a change in position of said bimetal strip alters the intensity of the magnetic field coupled between said magnet and said ferrite discs.

* * * * *